US010378731B2

(12) United States Patent
Gommans et al.

(10) Patent No.: US 10,378,731 B2
(45) Date of Patent: Aug. 13, 2019

(54) LIGHTING SYSTEM AND A METHOD OF GENERATING A LIGHT OUTPUT

(71) Applicant: SIGNIFY HOLDING B.V., Eindhoven (NL)

(72) Inventors: Hendrikus Hubertus Petrus Gommans, Eindhoven (NL); Jochen Renaat Van Gheluwe, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/765,508

(22) PCT Filed: Sep. 23, 2016

(86) PCT No.: PCT/EP2016/072663
§ 371 (c)(1),
(2) Date: Apr. 3, 2018

(87) PCT Pub. No.: WO2017/060101
PCT Pub. Date: Apr. 13, 2017

(65) Prior Publication Data

US 2018/0283656 A1 Oct. 4, 2018

(30) Foreign Application Priority Data

Oct. 9, 2015 (EP) ..... 15189040

(51) Int. Cl.
*F21V 13/00* (2006.01)
*F21V 5/00* (2018.01)
(Continued)

(52) U.S. Cl.
CPC ..... *F21V 13/10* (2013.01); *F21V 5/008* (2013.01); *F21V 5/04* (2013.01); *F21V 5/045* (2013.01);
(Continued)

(58) Field of Classification Search
CPC . F21V 13/10; F21V 5/008; F21V 5/04; F21V 5/045; F21V 9/02; F21V 11/06
See application file for complete search history.

(56) References Cited

U.S. PATENT DOCUMENTS 7,766,530 B2 8/2010 Hwang et al.
8,293,548 B2 10/2012 Cheng et al.
(Continued)

FOREIGN PATENT DOCUMENTS

WO 2011033444 A1 3/2011
WO 2012140579 A2 10/2012
(Continued)

OTHER PUBLICATIONS

"CoeLux skylight bring sunlight to windowless spaces"; http://www.gizmag.com/coelux-skylight/32469.
(Continued)

*Primary Examiner* — Anabel Ton

(57) ABSTRACT

A lighting module has an LED (44), a lens (45) over the LED to produce a beam-shaped output from the LED and a collimator (50) arranged to partially collimate the beam-shaped out-put. Blue light is provided at large angles to the normal, for example using a filter arrangement (54, 56) over the collimator which is adapted to filter light from the collimator at relatively large angles to the normal. The filter arrangement does not filter light from the collimator at relatively small angles to the normal. Thus, the module provides white task light in a normal direction and blue ambient light at steep angles. The overall system can be compact and light efficient.

11 Claims, 9 Drawing Sheets

(51) Int. Cl.

| | |
|---|---|
| ***F21V 13/10*** | (2006.01) |
| ***F21V 5/04*** | (2006.01) |
| ***F21V 9/02*** | (2018.01) |
| ***F21V 11/06*** | (2006.01) |
| *F21W 121/00* | (2006.01) |
| *F21Y 105/00* | (2016.01) |
| *F21Y 115/10* | (2016.01) |

(52) U.S. Cl.
CPC ..... *F21V 9/02* (2013.01); *F21V 11/06* (2013.01); *F21W 2121/008* (2013.01); *F21Y 2105/00* (2013.01); *F21Y 2115/10* (2016.08)

(56) References Cited

U.S. PATENT DOCUMENTS

| | | | | |
|---|---|---|---|---|
| 8,405,920 | B2 | 3/2013 | Premysler | |
| 8,500,300 | B2 | 4/2013 | Fang et al. | |
| 2007/0091615 | A1 | 4/2007 | Hsieh et al. | |
| 2010/0246176 | A1 | 9/2010 | Shyu | |
| 2012/0268950 | A1 | 10/2012 | Parkyn et al. | |
| 2014/0185285 | A1* | 7/2014 | Jorgensen | F21V 14/02 362/232 |
| 2017/0328540 | A1* | 11/2017 | Paul | G02B 26/008 |

FOREIGN PATENT DOCUMENTS

| | | | |
|---|---|---|---|
| WO | 2012011410 | A1 | 1/2013 |
| WO | 2013011404 | A2 | 1/2013 |
| WO | 2013011481 | A2 | 1/2013 |
| WO | 2013050918 | A1 | 4/2013 |
| WO | 2013057610 | A1 | 4/2013 |
| WO | 2013061189 | A1 | 5/2013 |
| WO | 2013160823 | A1 | 10/2013 |
| WO | 2013160826 | A1 | 10/2013 |
| WO | 2012075721 | A1 | 5/2014 |
| WO | 2014076217 | A1 | 5/2014 |
| WO | 2014191250 | A1 | 12/2014 |
| WO | 2012049146 | A1 | 4/2015 |

OTHER PUBLICATIONS

"CoeLux: Adifical Sunlight That's Real Enough to Trick Your Camera and Brain", https://petapixel.com/2015/02/09/coelux-artifical-sunlight-thats-good-enough-fool-cameras-brain/.

* cited by examiner (a)

(b)

(c)

(d)

LIGHTING SYSTEM AND A METHOD OF GENERATING A LIGHT OUTPUT

CROSS-REFERENCE TO PRIOR APPLICATIONS

This application is the U.S. National Phase application under 35 U.S.C. § 371 of International Application No. PCT/EP2016/072663, filed Sep. 23, 2016 which claims the benefit of European Patent Application No. 15189040.7 filed on Oct. 9, 2015. These applications are hereby incorporated by reference herein.

FIELD OF THE INVENTION

This invention relates to interior lighting systems.

BACKGROUND OF THE INVENTION

People generally prefer daylight over artificial light as their primary source of illumination. Everybody recognizes the importance of daylight in our daily lives. Daylight is known to be important for people's health and well-being.

In general, people spend over 90% of their time indoors, and often away from natural daylight. There is therefore a need for artificial daylight sources that create convincing daylight impressions with artificial light, in environments that lack natural daylight including homes, schools, shops, offices, hospital rooms, and bathrooms.

Artificial daylight sources on the market focus mainly on high intensity, tunable color temperature, and slow dynamics (day/night rhythms). It is also known to create a sky view in a ceiling using a display or foil.

There has been significant development of lighting systems which try to emulate daylight even more faithfully.

Current technology used to create daylight effects is often based on fluorescent solutions with a strong diffuser on top. It is possible to create tunable intensity and tunable color temperature solutions using this approach. However, many of these solutions do not provide a realistic daylight experience because there is hardly any direct light to provide sharp shadows. Indeed, one particular feature of natural daylight which has not been well emulated is the relation between diffuse and direct light. Direct light provides sharp shadows whereas diffuse light is less intense. An impression of natural daylight is much stronger when direct light and diffuse light components are combined. This issue has been recognized, and artificial skylight systems have been proposed that simulate a number of daylight features, including for example the sky appearance with blue diffuse light and white direct light.

For example, it has been proposed to create a blue (i.e. clear sky) appearance when a user looks at the skylight at an angle (i.e. typically 40-90 degrees offset from the normal downward direction, which is the typical viewing angle range for a skylight), but still emits mainly white light in an angular area 0-40 degrees from the normal of the skylight surface, i.e. downward. This white light provides functional lighting. This approach is based on the combination of two main elements:

(i) an area light source to create an area of uniform white light;

(ii) a blue tubular grid that lets through the white light of the area light source in the direction perpendicular to the exit window unaltered, while filtering the light by an increasing degree for directions deviating from the perpendicular direction. The filtering renders the light blue.

In respect of the area light source, one approach is to use a direct lit mixing box to create a uniform white light source in combination with a microlens optic (MLO) plate to shape the light. Another approach is to use an edge lit lightguide with outcoupling structures to create a uniform backlight.

One problem with this approach generally is that the optical efficiency may be low since the uniform area light sources used have a rather wide beam, resulting in a large fraction of the beam being absorbed by the blue grid. This results in the over-installation of LEDs to compensate for this and reach the desired light levels. The problem arises because it is challenging to create both a uniform area light source and which is also collimated.

Another problem is that the white light is not extremely well collimated, for example with an approximate beam width of about 2×30 degrees, and therefore does not give the impression of direct sunlight in the room.

An additional requirement of all solutions is that the total system should have a limited depth, so it can be installed in existing buildings without the need for considerable structural modifications to the buildings.

There is therefore a need for a lighting system design which is able to provide a blue appearance when looking at a grazing angle into the luminaire, whereas a relatively highly collimated warm white light output is provided for task light, that creates a highly uniform spot corresponding to the shape of the luminaire. There is a need for a system which can achieve these aims with limited depth, for example less than 10 cm.

SUMMARY OF THE INVENTION

The invention is defined by the claims.

According to the invention, there is provided a lighting system comprising:

a lighting module comprising:

an LED;

a lens over the LED to produce a beam-shaped output from the LED;

a collimator arranged to partially collimate the beam-shaped output, said collimator comprising a total internal reflection Fresnel lens; and a blue light generator for providing blue light at relatively large angles to the normal, wherein the collimator provides an output which comprises a narrow collimated relatively high intensity beam and a wide relatively low intensity beam; and wherein the blue light generator further comprises a filter arrangement over the collimator, the filter arrangement being adapted to filter light from the collimator at relatively large angles to the normal to provide blue light; and wherein the filter arrangement does not filter light from the collimator at relatively small angles to the normal.

This arrangement is able to create a uniform area light source within a limited depth, which is highly collimated. This improves the optical efficiency and for example allows the use of fewer LEDs for a given area (therefore with larger pitch). Blue light is provided at large angles to the normal.

By "normal" is meant the normal to the plane of the light exit surface of the LED, i.e. the optical axis of the LED. By "relatively large angle to the normal" is meant away from the normal, for example at least 40 degrees or at least 45 degrees away from the normal (i.e. at angles closer to the plane of the LED light output surface than to the normal). These are the steep so-called "grazing" angles from which a luminaire is directly seen by a user. By "relatively small angle to the normal" is meant away from the normal, for example less than 40 degrees or less than 45 degrees away from the normal (i.e., at angles closer to the normal than the plane of the LED light output surface).

The blue light generator for example comprise a filter arrangement over the collimator, which is adapted to filter light from the collimator at relatively large angles to the normal to provide blue light, wherein the filter arrangement does not filter light from the collimator at relatively small angles to the normal. In this way, light from the single light source, such as an LED with a white output, is used to create both collimated white light and larger angle blue light. The filter arrangement may comprise an array of blue filter cells which extend parallel to the normal direction.

The LED for example generates an output with a Lambertian intensity distribution, which is to be converted by the lens element. This means a standard LED package can be used without any other beam shaping optics. The output intensity of the module for example then has a batwing distribution. This is of particular interest for generating a uniform illumination over a planar surface.

The lens may comprise an inner surface and an outer surface, wherein one of the inner and outer surfaces is a beam shaping surface which provides a beam shaping function, and the other of the inner and outer surfaces is a pass through surface which provides a pass through function.

In this design, the one surface functions as a pass through surface, performing no or substantially no beam shaping function. Note that a true pass through mode will in practice only apply if the LED is assumed to be a point source, and the finite size of an actual LED means there will be some rays which refract at the pass through surface. However, the optical function of that surface is essentially minimized to provide no beam shaping for rays originating from a point source which is an approximation of the LED source.

The beam shaping surface is for example shaped such that rays emitted along the optical axis are refracted away from the optical axis by at least 5 degrees, and rays approaching 90° to the optical axis are refracted towards the optical axis by at least 5 degrees. This is the required optical function to generate a batwing profile.

In one set of examples, the inner surface is the beam shaping surface and the outer surface is the pass through surface. The outer surface may then be brought in towards the inner surface to reduce the size. This means the inner surface can be designed by conventional approaches, since the outer surface then performs no additional optical function. The lens may then comprise a bubble lens.

However, in another set of examples, the outer surface is the beam shaping surface and the inner surface is the pass through surface. The inner surface may then be brought out towards the outer surface to reduce the size. This means the outer surface can be designed by conventional approaches, since the inner surface then performs no additional optical function. The lens may then comprise a so-called peanut lens, in which there is an elongate length direction with an enlarged portion at either end and a depressed part at middle where the two end parts connect. The exit light beam from an LED light module is in this way elongated, for example in the shape of an elliptic periphery, and a distribution curve flux of which is in a batwing shape. The lens may be symmetrical about the length axis and also about a perpendicular axis, but this is not necessarily the case.

The pass through surface for example has a stepped profile, wherein the steps of the stepped profile each comprise a riser portion and an output portion, wherein the riser portions are parallel with a ray direction originating from a point output of the LED and the output portions are normal to the ray direction.

The use of a stepped surface means the thickness of the lens, namely between the inner and outer surfaces, may be reduced. The thickness may be made to be substantially constant overall when ignoring the variations in thickness due to the steps.

The output intensity of the lens for example has a batwing intensity distribution.

The collimator may for example comprise a total internal reflection (TIR) Fresnel lens. This is a well-known collimator design which can be formed as a thin profiled sheet. The lens may contain a series of surfaces of the same curvature with stepwise discontinuities between them. The lens may contain a series of flat surfaces with a different angle in each section. Such a Fresnel lens may be regarded as an array of prisms, the prisms may be arranged with steeper prisms on the edges and a flat or slightly convex center section. A prism is a solid object with identical ends, flat faces and the same cross section along its length. The prism can be considered a polyhedron.

The collimator may provide an output which comprises a narrow collimated relatively high intensity beam and a wide relatively low intensity beam. The term relatively here is taken to mean that the narrow collimated beam has a high intensity relative to the intensity of the wide beam and also that the wide beam has a low intensity relative to the narrow collimated beam. The collimator is designed to create the collimated light. Stray light for example provides wide beam illumination that is usually present due to for example Fresnel reflections. The degree of collimation alters the relative intensity of the light beam, for example, if the approximate beam angle is 10° it will appear to have a higher intensity than if the approximate beam angle is 50°, this is because more light rays are present in a tighter beam in the 10° example. The degree of collimation can be altered by adjusting the number of prisms, the angles of the prism faces or the distances between adjacent prisms. This stray light can be further increased if desired by white paint surfaces.

The lighting module may further comprise a blue light source at the output of the collimator for providing a wide beam blue light output. If the light output created by the collimator is very highly collimated, there may be insufficient light at the steep angles to create a desired blue effect using a filter arrangement as explained above. Additional light sources may thus be used to increase the steep angle illumination.

Alternatively, the collimator may comprise colored regions and non-colored regions. This collimator may comprise a Fresnel lens and the lens may comprise an array of prisms. The prisms closer to the center region of the lens may be non colored and as such impart no color to the light passing through that region. The prisms closer to the edge of the collimator may be colored, for example, they may be colored blue. This means that light passing through the colored prisms may become colored, for example blue. The appearance of the collimator when viewed at large angles to the normal of the plane of the light exit surface of the LED may be blue around the edges with a whiter region towards the centre.

The invention also provides an artificial skylight comprising a lighting module as defined above.

The invention also provides a Fresnel lens suitable for use in a lighting module as defined above.

Examples in accordance with another aspect of the invention provide a method of generating a light output, comprising:

providing a light output from an LED;

beam shaping the light output using a lens to create a beam-shaped output;

partially collimating the beam-shaped output; and providing blue light at relatively large angles to the normal.

Providing blue light for example comprises filtering the partially collimated beam-shaped output thereby to filter light from the collimator at relatively large angles to the normal to provide blue light and not to filter light from the collimator at relatively small angles to the normal.

The beam shaping for example comprises creating a batwing distribution. This is used to provide a uniform surface illumination of the collimator used for the partial collimation.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a lighting module which has an LED, a lens over the LED to produce a beam-shaped output from the LED and a collimator arranged to partially collimate the beam-shaped output. Blue light is provided at large angles to the normal, for example using a filter arrangement over the collimator which is adapted to filter light from the collimator at relatively large angles to the normal. The filter arrangement does not filter light from the collimator at relatively small angles to the normal. Thus, the module provides white task light in a normal direction and blue ambient light at steep angles. The overall system can be compact and light efficient. An alternative is to provide a collimator comprising colored regions and non-colored regions. The colored regions may comprise an array of colored prisms and these colored prisms may form the region of the collimator closest to the edge whilst the prisms that form the center region of the collimator may be non colored. This means that the light that passes through the colored regions may become colored whilst the light that passes through the center region of the collimator may remain the same color as emitted by the LED.

The invention is based on the combination of an optical system for creating a uniform light output across an area, and a collimating unit for at least partially collimating the light output. In preferred examples, the (partially) collimated light output is passed through a filter arrangement to create the desired blue effect at steep angles. Alternatively, in other examples the collimator comprises blue regions near the edges to create the desired blue effect at steep angles.

One known approach to achieve a uniform illumination of a surface area is to use a so-called batwing intensity distribution (also referred to as a wide beam intensity distribution). The term batwing refers to a highly peaked shape of the intensity distribution in a polar plot.

Figure 1:
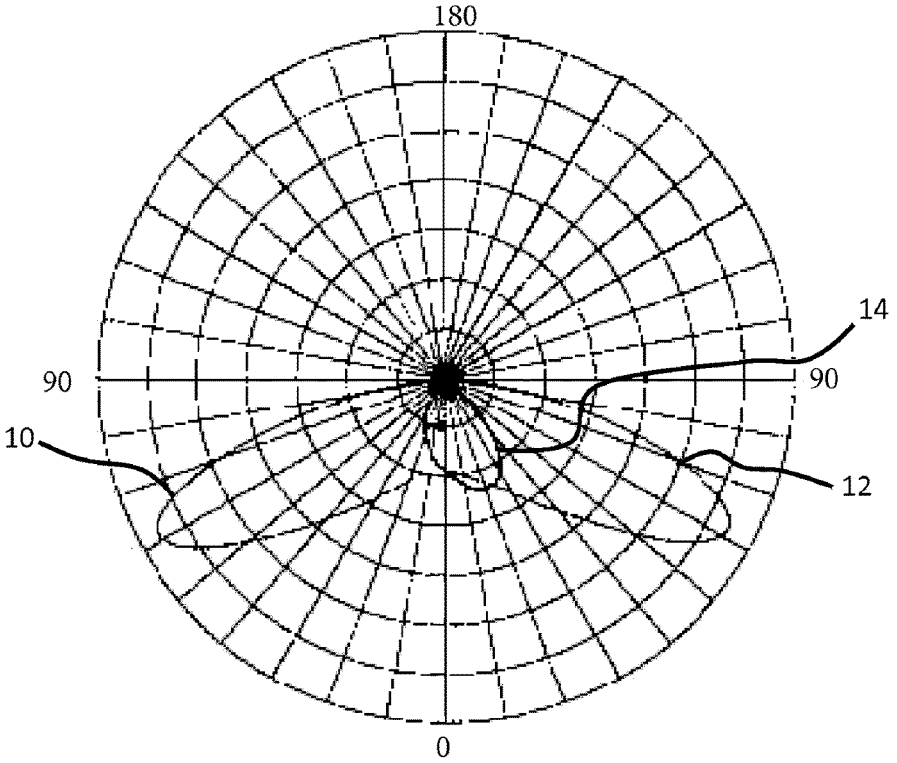
FIG. 1 shows a known batwing intensity distribution.

FIG. 1 shows an example of a batwing intensity distribution as a polar plot. The two wings 10, 12 in this example have a peak intensity at 60 degrees each side of the normal, and the aim is to provide a uniform surface illumination over the full 120 degree range. The intensity is higher at the grazing angles because the surface area being illuminated per unit angle increase steeply.

The ring 14 is the light intensity in a perpendicular direction. For a rotationally symmetric light distribution this would be a batwing distribution as well. For a linear light source it is for example a circle (i.e. Lambertian), distribution.

To create the desired batwing profile from an LED, an optical component is required to compensate the well-known cosine fourth law which applies to a Lambertian point source (by which illuminance falls following a $\cos^4 \theta$ function). The optical design thus needs to change the Lambertian intensity distribution from an LED output intensity into the batwing distribution.

The batwing light distribution allows for a uniform illumination of a planar surface for example even up to a 140° beam angle. Such light distributions and hence lens designs may be used for example in street lighting, car parks and wall washer applications. In these examples, the batwing distribution targets a planar surface in the far field: the illuminated surface is positioned at a distance much larger than the light module dimensions. The light distribution may however also be applied for short range illumination, for example to illuminate the interior of a luminaire housing, e.g. the exit window of a luminaire. This would then create a spatially uniform luminescent panel.

A known alternative approach for increasing spatial uniformity in a luminescent panel is by extensive scattering: using reflective matte white surfaces at the inner side of the casing or well-designed white paint dot patterns on a light guide. Scattering based solutions typically allow for a high spatial uniformity at the expense of efficiency and/or form factor. Moreover, the light distribution at the exit window will be limited to a Lambertian distribution at each position of the surface, while an optical element with a batwing design may instead assign a constant flux to each position from a known direction, i.e. the light source position. This allows for further beam shaping at the exit window position.

There are two known designs of lens capable of changing a Lambertian intensity distribution into a batwing intensity distribution.

Figure 2:
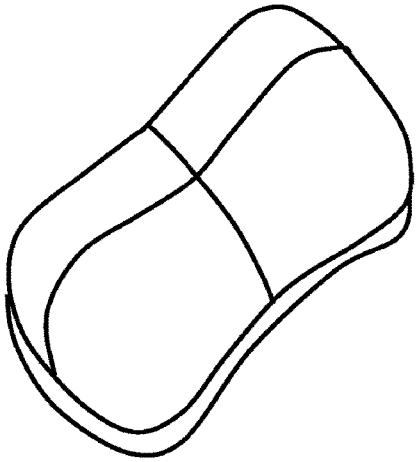
FIG. 2 shows in simplified form the shape of a peanut lens.
Figure 3:
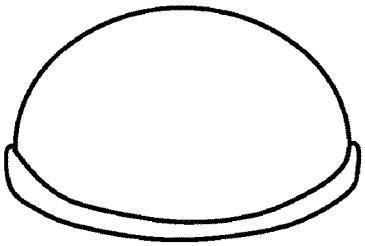
FIG. 3 shows in simplified form the shape of a bubble lens.

A first example is a so-called peanut design as shown in FIG. 2 and a second example is a so-called bubble optic as shown in FIG. 3. The peanut lens has an outer shape which is elongate, with an enlarged portion at either end, and generates an elongated output profile but with a batwing intensity profile. The bubble optic has an essentially dome shaped outer surface.

The difference in shape is determined by the choice of ray deflecting surface. The surface changing the Lambertian distribution into a batwing is for the peanut optic the outer lens surface while for the bubble optic it is the inner surface.

Figure 4:
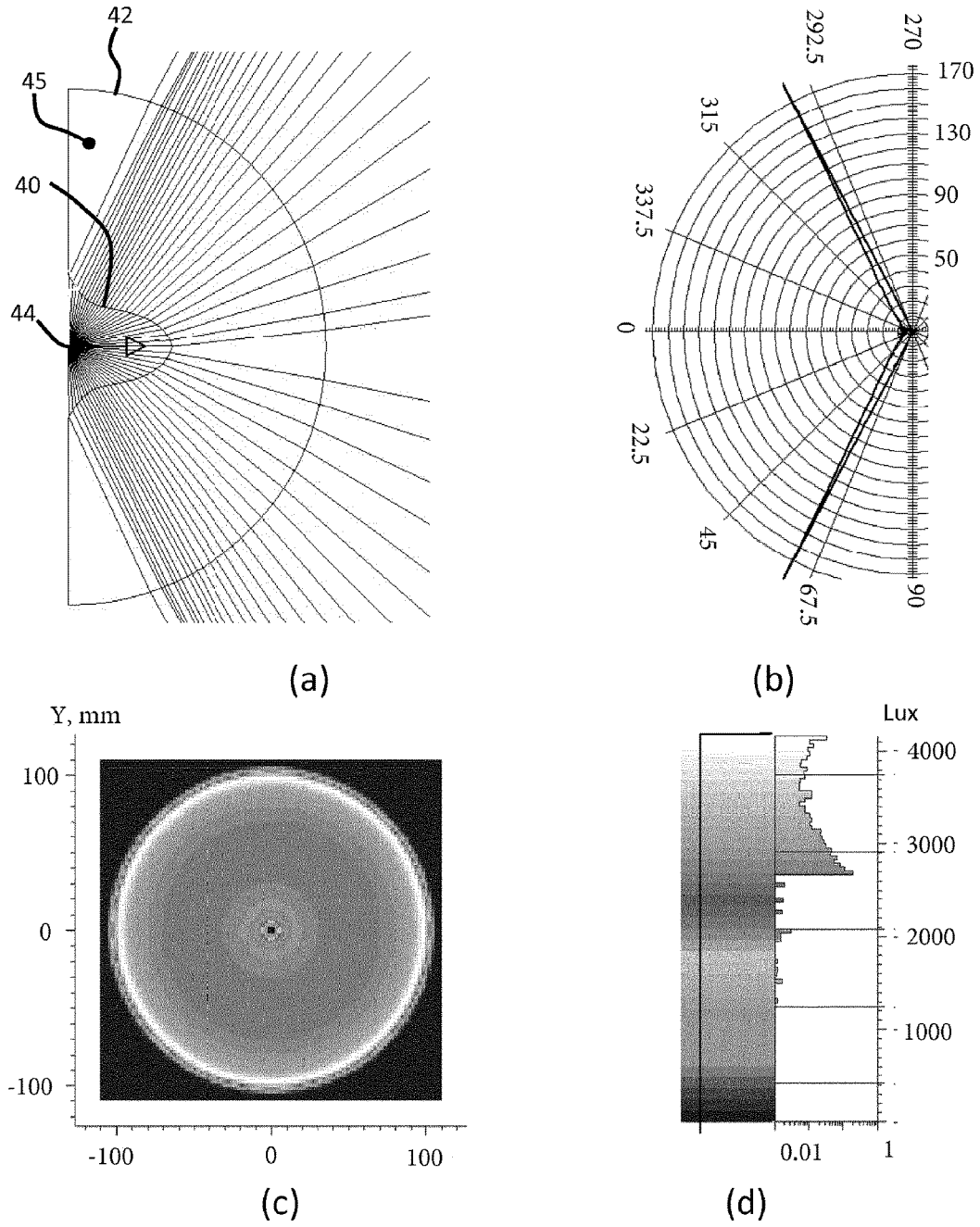
FIG. 4 shows the shape of the internal and external surfaces of a known bubble lens more clearly, and shows the ray paths through the lens, the intensity distribution at the output, and the intensity distribution when projected on a surface.

FIG. 4 shows a known bubble lens design. FIG. 4(*a*) shows the shape of the lens 45 in cross section. It has an inner surface 40 and an outer surface 42. The LED 44 is mounted in an air cavity beneath the inner surface. The lens is formed from a material of refractive suitable index such as polycarbonate (PC) or Poly(methyl methacrylate) (PMMA). Other possible materials are silicones, polyethylene terephthalate (PET), Polyethylene naphthalate (PEN), and cyclic olefin copolymer (COC).

The inner surface 40 performs the main lensing function and as shown, rays near the normal are bent away from the normal and lateral rays are bent towards the normal. This defines the batwing profile. By way of example, the beam shaping surface is shaped such that rays emitted along the optical axis are refracted away from the optical axis by at least 5 degrees or at least 10 degrees, and rays approaching 90° to the optical axis are refracted towards the optical axis by at least 5 degrees or at least 10 degrees.

For this conventional bubble optic design, the outer surface 42 is located at sufficiently large distance such that it can be approximated by a hemisphere, and it performs some limited additional beam shaping.

FIG. 4(*b*) shows the batwing intensity profile.

FIG. 4(*c*) shows the intensity distribution on a planar surface at a distance from the LED such that a circle of illumination is formed of radius 10.7 cm. For the analysis conducted, a 100 lm LED package was used, with a planar receiver positioned at 5 cm from the source and a far field receiver was used to calculate the intensity distribution. The optically active surface 40 is designed to uniformly illuminate the planar receiver at 5 cm distance up to a full angle of 130°: i.e. to generate a uniformly lit circular spot with radius of 10.7 cm (=5 cm×tan 65°). The uniform illuminance value would then yield 2770 lux (=100 lm divided by the spot area).

In practice, there is illumination over the full area, but there are bands of different intensity at different radius. This is shown by different shading in the image of FIG. 4(*c*). The light intensity distribution is represented in FIG. 4(*d*) which functions as a key for FIG. 4(*c*).

Each shading depth in FIG. 4(*c*) is plotted in FIG. 4(*d*) to the left, and the right side of FIG. 4(*d*) provides a measure for the number of pixels in the illuminated surface that have that particular intensity value. The x-axis is a count value and the y-axis is a luminance value. For example, for a perfectly uniformly illuminated area, there will be only one peak for one particular light intensity, and the count will be the full number of pixels.

As can be seen in FIG. 4(*d*) there is a range of intensity values, and two general peaks (at around 4000 lux and 2800 lux).

Figure 5:
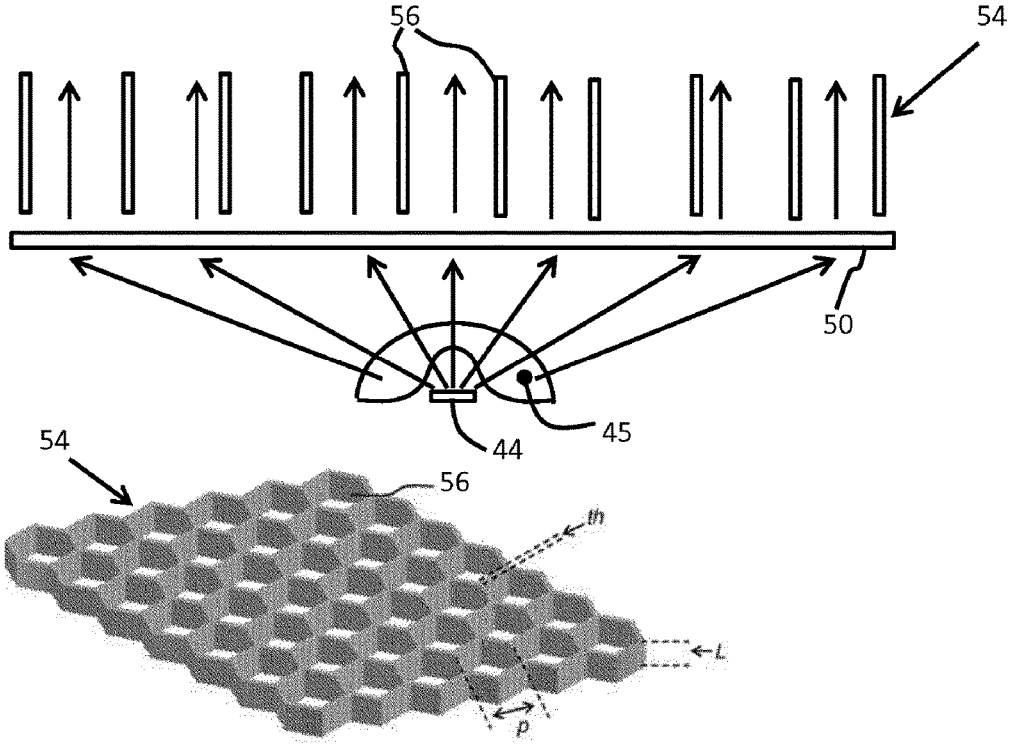
FIG. 5 shows a lighting module.

The invention provides a system which combines a lens of the general type shown in FIG. 4, with a collimator and blue filter arrangement. FIG. 5 shows the lighting system. It comprises an LED 44 and a lens 45 of the general type shown in FIG. 4 which functions as a pre-collimator. The surface of a second collimator 50 is illuminated and it provides a more collimated output. At the output side of the second collimator 50 is a grid 54 of blue filters 56.

The lens 45 is a generally dome shaped lens of the type explained above, and it redirects all rays emitted from the source 44, such that it illuminates the second collimating element 50 in a generally uniform manner. Using this first element 45 enables the number of light sources to be reduced in order to provide a uniform appearance.

The second collimating element 50 collimates all rays such that it mimics direct sunlight. In one example, it comprises a total internal reflection (TIR) Fresnel lens. In the example used to simulate the system, the peak intensity is 2500 cd/m$^2$, the beam angle (full width half maximum) is 0.64°, and the field angle (full width tenth maximum) is 1.8°.

For a real daylight experience, the peak intensity should be as high as possible and the beam and field angle as low as possible:

Direct sunlight has a full width of about 0.5° and can be as bright as $1.6\times10^9$ cd/m$^2$. To achieve a minimal sunlight experience requires at least 2000 cd/m$^2$ (equal to the luminance of an average cloudy sky) and a beam angle of 20°.

Ignoring material absorption and Fresnel reflections, the optical efficiency is 100%.

The grid 54 causes rays at steep angles to be filtered so that a blue appearance is obtained from these grazing angles. The steeper the angle, the more blue filters will be in the path of the light, so that the filtering effect is a function of the angle.

The type of grid which may be used is described in detail in WO 2012/140579.

The filter is a cellular structure with walls consisting of (semi-) transparent blue material. Light from the source (i.e. coming from the collimator) that is not parallel to the walls of the cells passes though the cell walls and is partially filtered by removing (i.e. absorbing) the non-blue components of the spectrum. Light exiting the collimator at larger angles passes through multiple cell walls and is thus more filtered. The transmitted light therefore becomes more bluish at larger angles.

The grid is typically a regular arrangement, for example a hexagonal array or a rectangular array of cells with vertical walls. The cells can have different shapes: circular, hexagonal, square . . . and are typically open at both ends.

A variation to the semi-transparent walls is a similar grid structure with non-transparent blue walls. The blue component of the light coming from the collimator which is incident on the cell wall is reflected (specularly or scattered) by the wall, while the non-blue spectral components are absorbed.

FIG. 5 shows one example of grid structure in the form of a hexagonal cell structure. The filters 56 have a length L (i.e. the thickness of the grid) and a pitch p, with cell wall thickness "th". By way of example, the length L may be of the order of 10 mm (e.g. in the range 5 mm to 20 mm) and the pitch p may be around 7 mm (e.g. in the range 5 mm to 20 mm). The wall thickness "th" may be around 0.5 mm.

Figure 6:
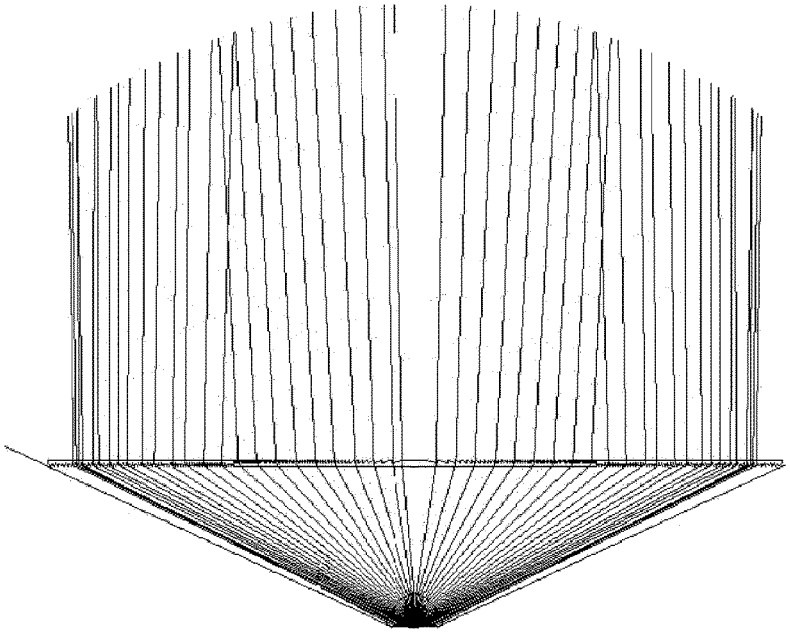
FIG. 6 shows the beam paths through the lighting module of FIG. 5.

FIG. 6 shows the beam paths through the lens 45 and the second collimating element 50.

The degree of collimation may be exceptionally high as light is deflected using an étendue conserving design and the surface area of the emissive plane (the second element 50) is for example $3.6\times10^4$ times larger than the surface area of the LED (based on an LED area of 1 $mm^2$ and an illumination area of radius 10.7 cm).

This exceptional degree of collimation matches the application requirements of mimicking direct sunlight and minimizes the loss caused by the blue grid.

Simple tiling of this solution allows the creation of larger uniform, collimated sources. To mitigate potential tiling artifacts, a mild controlled diffuser can be added (typically with a diffuser angle of less than 10 degrees), which will hide tiling artifacts while at the same time only slightly lowering the collimation.

The overall design enables the number of LEDs to be reduced within an array. A suitable LED pitch can be estimated as $2\times h\times\tan\varphi$, where the h is the height spacing between the plane of the LED 44 and the plane of the collimator 50, and $\varphi$ is the maximum extraction angle of the lens (to one side of the normal). This height h for example ranges from 10 to 200 mm and $\varphi$ ranges from 45° to 75°. The pitch then ranges from 20 to 1500 mm.

In order to reduce the size of the system, the design of FIG. 4 may be modified by bringing the optically less active surface (which in FIG. 4 is the outer surface 42, but may be the inner or the outer surface depending on the design) as close to the optical active surface 40 as possible.

Figure 7:
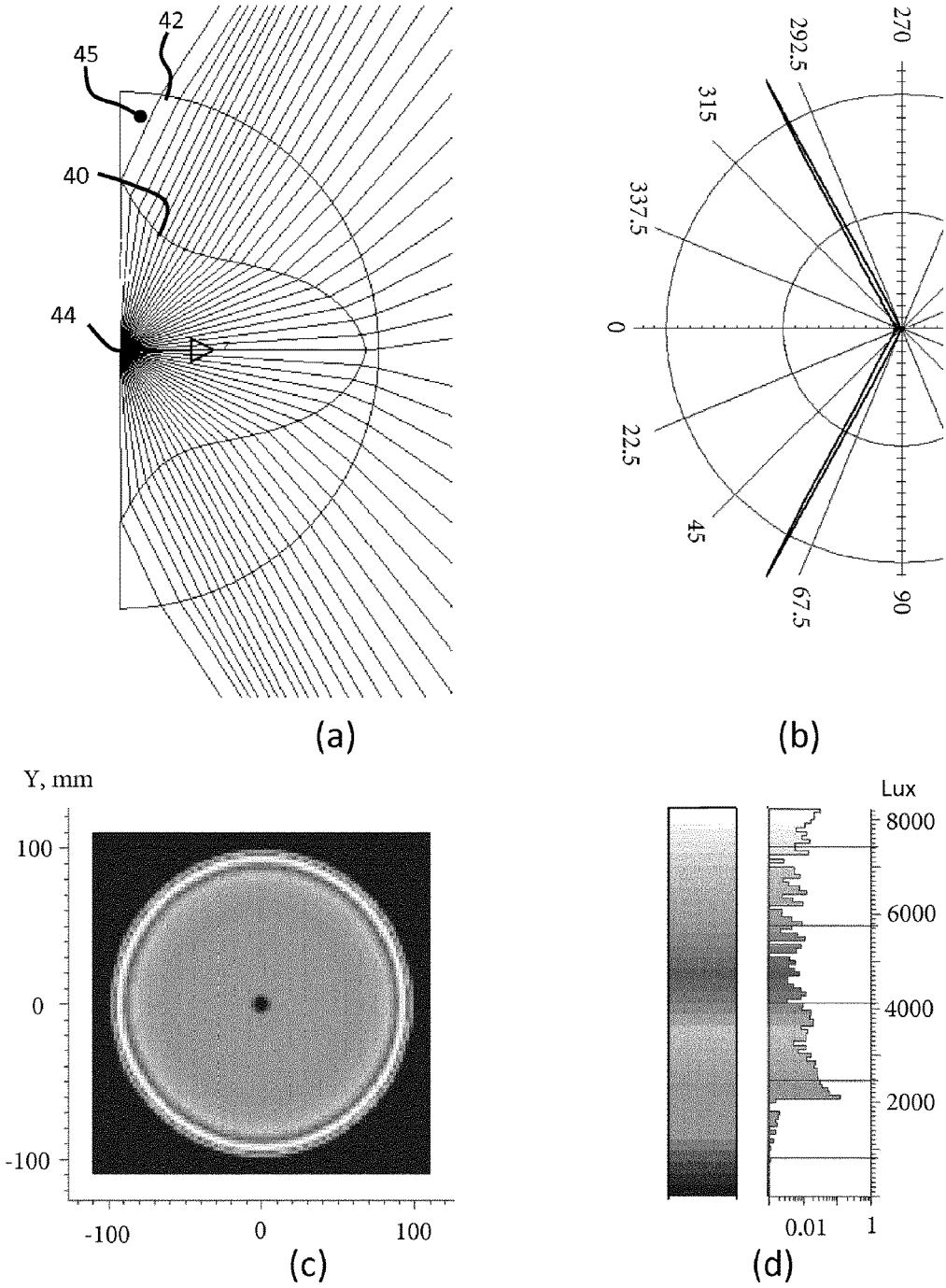
FIG. 7 shows the shape of the internal and external surfaces of a first example of a modified bubble lens, and shows the ray paths through the lens, the intensity distribution at the output, and the intensity distribution when projected on a surface.

FIG. 7 shows the shape of the internal and external surfaces of a first modified example of bubble lens based on the design of FIG. 4 and shows the same information as in FIG. 4.

In FIG. 7, the bubble optic has a hemispherical dome of reduced thickness. The thickness directly over the LED is reduced to 1 mm or less, for example 0.8 mm, 0.6 mm or even 0.5 mm.

The inner surface again provides the main optical functionality. As shown, the outer surface also performs some lensing function as well.

Simply reducing the size of the outer hemispherical surface in the manner shown in FIG. 7 yields an even more pronounced peaked light distribution at the outer diameter of the beam spot. The reduction in size thus comes at the expense of a deteriorated optical beam shaping function.

FIG. 7(*d*) also shows that there is a much broader range of light intensities and therefore a less uniform overall light intensity.

Figure 8:
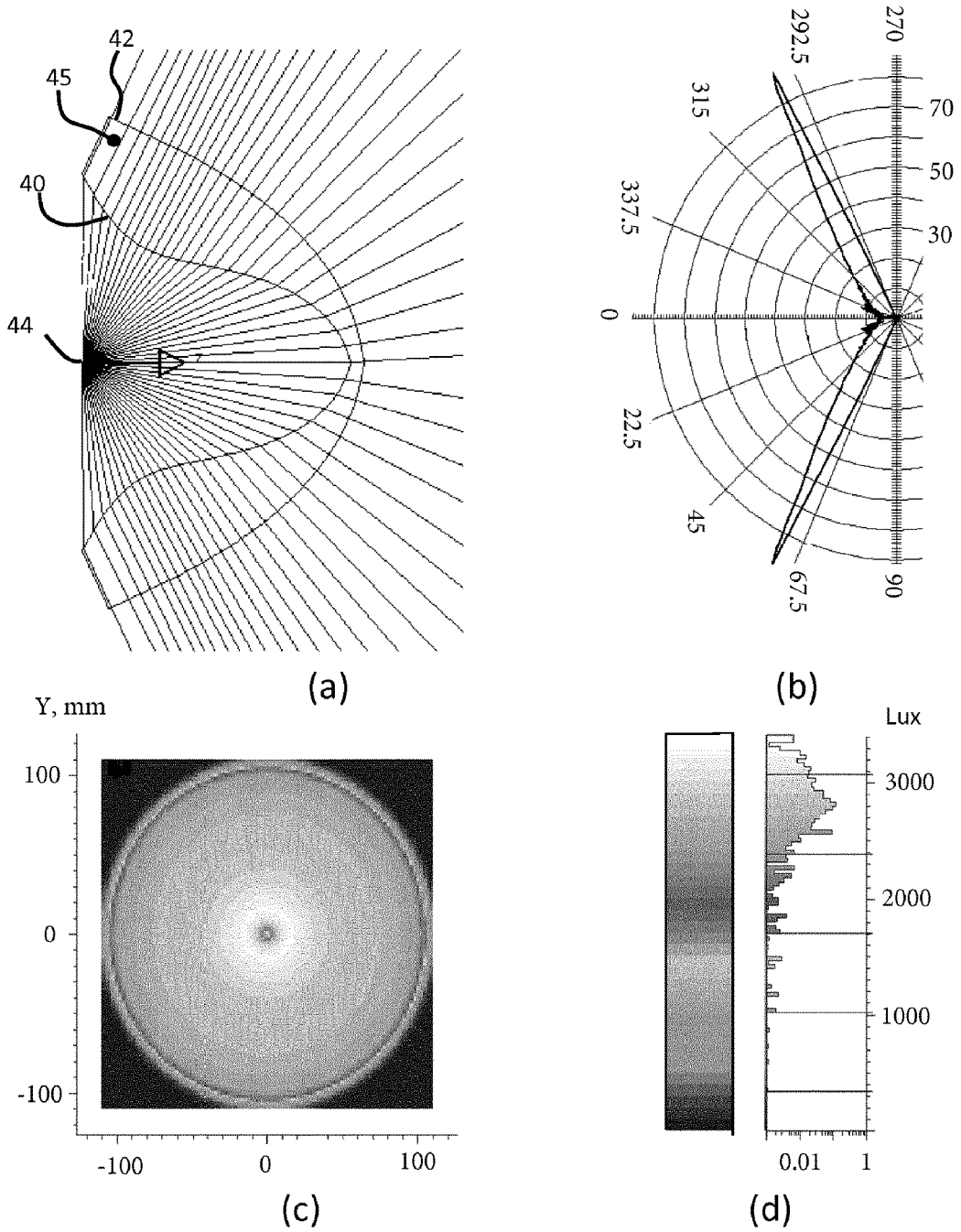
FIG. 8 shows the shape of the internal and external surfaces of a second example of a bubble lens with an optically inactive surface, and shows the ray paths through the lens, the intensity distribution at the output, and the intensity distribution when projected on a surface.

FIG. 8 shows the shape of the internal and external surfaces of a second modified example of bubble lens more clearly with an optically inactive outer surface, and shows the ray paths through the lens, the intensity distribution at the output, and the intensity distribution when projected on a surface. It also shows that the outer shape is converted from a hemispherical shape to a slightly conical shape in order to provide a desired optically inactive surface, To create the optically inactive outer surface, the surface is perpendicular to the ray travel direction at each location (assuming the LED to be a point source, so that there is only one ray direction through each location of the outer surface).

To define the shape of the outer surface, the shape is chosen so that a ray crosses this surface without deflection. For this, it is calculated under which angle the ray is incident at the outer surface and the orientation of the surface at that location is calculated accordingly.

At the light extracting surface side, if the extracting surface 42 is sufficiently far from the collecting surface 40 the rays can be approximated as coming from a single point, as opposed to the inner surface.

By bringing the outer extracting surface 42 closer, it becomes necessary to correct for this approximation. This gives rise to the conic shaped outer surface 42 of FIG. 8. The inner collecting surface 40 can thus still be approximated by a point source approximation.

The conic surface allows the material volume to be reduced up to a certain limit when at some point the lens thickness has reached its minimal value of say 1 mm. This minimal lens thickness can be seen in FIG. 8 to be located at the optical axis.

FIG. 8(*d*) shows that this design enables a more uniform light distribution, with essentially one peak at around 2800 Lux.

The inner surface 40 deflects the rays from the Lambertian emitter to a planar screen at 50 mm distance up to 65° degrees in a uniform manner. The height and width of the lens element 45 is 10 mm and 18 mm respectively and the source diameter is chosen as 1 mm.

A further reduction in the lens volume is possible, for example with the lens volume reduced by applying the same minimal thickness across the whole lens area. In order to enable the size to be reduced further while maintaining no optical effect at the second surface 42, the outer surface is adapted so that it is no longer a smooth surface. Instead it is formed with a stepped profile with a series of facets.

Figure 9:
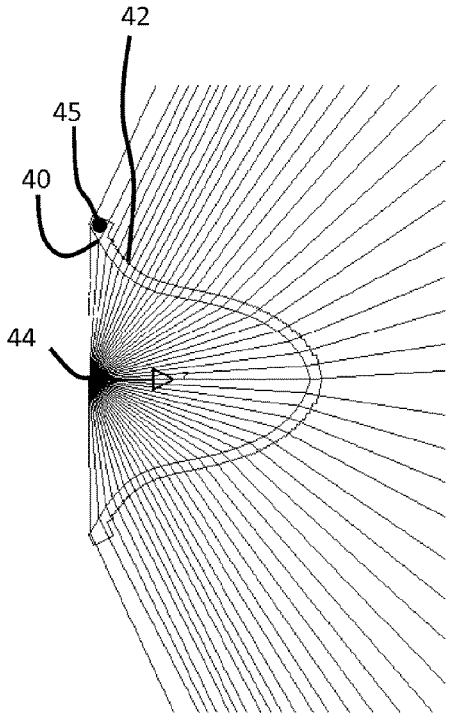
FIG. 9 shows the shape of the internal and external surfaces of a third example of a bubble lens with an optically inactive surface, and shows the ray paths through the lens, the intensity distribution at the output, and the intensity distribution when projected on a surface.
Figure 9:
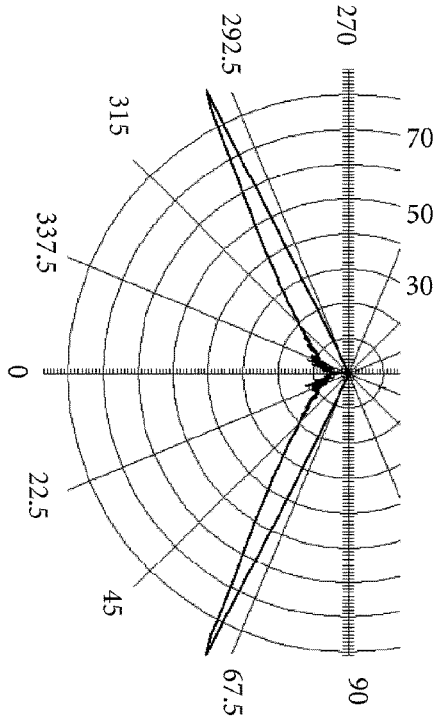
Figure 9:
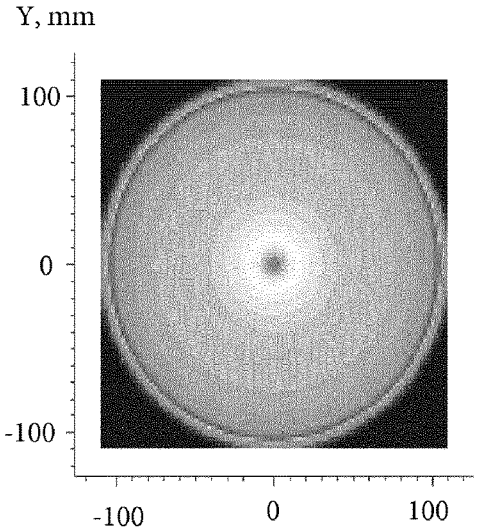
Figure 9:
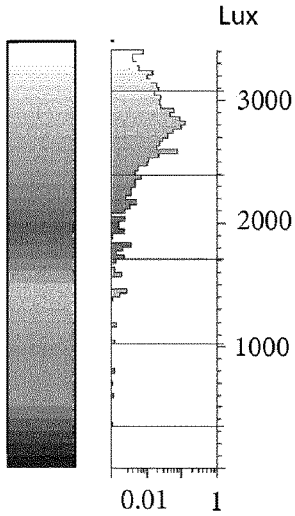
Figure 10:
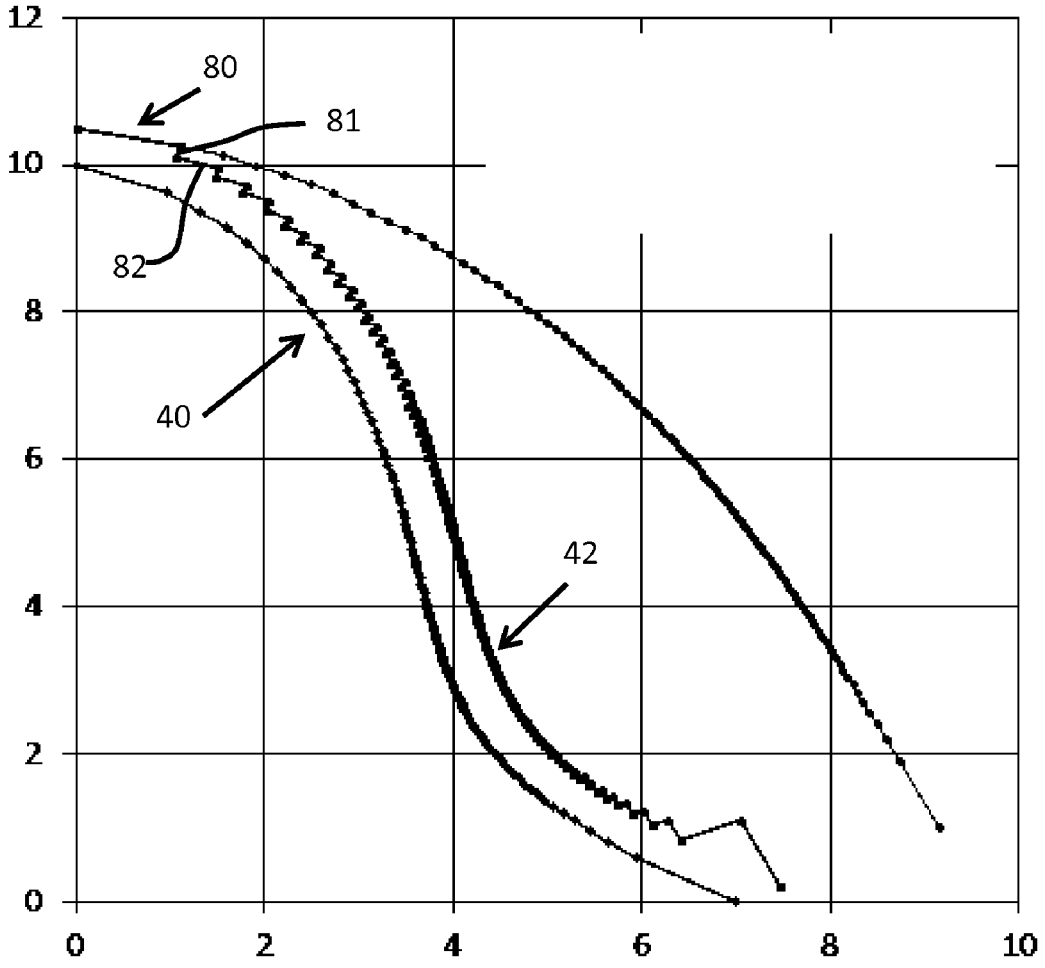
FIG. 10 shows the shapes of the stepped portion in more detail for a bubble lens.

A first example is shown in FIGS. 9 and 10. FIG. 9 shows the shape of the internal and external surfaces when the stepped surface is applied to a bubble lens, and again shows the ray paths through the lens, the intensity distribution at the output, and the intensity distribution when projected on a surface. FIG. 10 shows the stepped surface in more detail.

The steps of the stepped profile each comprise a riser portion and an output portion, wherein the riser portions are parallel with a ray direction originating from a point output of the LED (i.e. from a point source which is assumed to represent the output of the LED) and the output portions are normal to that ray direction. Thus, the light does not impinge on the riser portions because they are parallel to the light direction, and the output portions do not bend the light due to the perpendicular relationship.

The inner surface 40 is fully determined by the incident luminous intensity and the target luminous intensity. Generally, the incident intensity is Lambertian and has a cosine dependence. For a batwing distribution the inner surface 40 is shaped such that rays emitted at 0° will refract away from the optical axis, while rays near 90° refract towards the optical axis. As a result there is always a surface location where the optical activity (dioptric power) is approximately zero. Such ray description determines the inner surface shape.

The stepped profile applied to the outer surface 42 is to minimize the total lens volume. This can be implemented by shifting each facet element parallel to the exit ray as close as possible towards the inner surface. As the outer surface has no optical activity, the draft facets (the upright parts of each step) remain parallel to the rays and cannot collect any flux, which renders it an efficient design.

As long as the outer surface 42 is perpendicular to the traveling rays it is possible to reduce the distance between inner and outer surface as the draft facets of each step are oriented perfectly parallel to the rays.

In the design of FIGS. 9 and 10, at each position around the lens, the general distance between the inner and outer surface is reduced to a minimal distance to reduce the amount of material needed. The thickness may again be 1 mm or less, for example less than 0.8 mm or less than 0.6 mm. This design may be considered to be a bell shaped lens.

FIG. 9(*d*) shows that the single intensity peak is preserved so that a relatively uniform output illumination is maintained.

As mentioned above, the design of FIG. 9 makes use of a stepped lens surface. This is shown in exaggerated form in FIG. 10 for the lens design of FIG. 9.

FIG. 10 shows the set of facets 80 more clearly and shows the riser portions 81 and the output portions 82. The riser portions 81 are parallel with the incident ray direction and the output portions are perpendicular to that ray direction.

The discretization of the stepped surface is based on the collected lumen.

If the facets are sufficiently short, they may be straight, i.e. planar, without significantly affecting the optical performance. They may instead be curved if a coarser grid is chosen, with the local curvature defined by the non-stepped conic surface shape in FIG. 6. Any desired level of discretization may be chosen.

By way of example, there may be between 10 and 500 steps, for example between 20 and 400 steps, for example between 20 and 200 steps. The steps follow a contour around the lens. The steps are for example annular circles (for a rotationally symmetric design) or ellipses or more complicated shapes (for example a path around a peanut lens shape). There may generally be more than 10 steps, more preferably more than 20 steps and even more preferably more than 50 steps.

The surface fidelity of a smooth surface is for conventional manufacturing technologies higher than that of a stepped surface. Hence the stepped surface design has a different optimum in the trade-off between material cost and cycle time versus surface quality. Different levels of discretization will give a different trade-off between volume and ease/accuracy of manufacture of the lens shape.

At the limit, the design enables the amount of material to be minimized, given a minimum required thickness. For example the maximum thickness between the inner and outer surfaces over the whole area of the inner and outer surfaces may be less than three times or even less than two times the minimum thickness. Thus, a relatively constant thickness is provided. The thickness variations may arise only from the stepped features rather than from the general overall shape. Thus, by averaging out the steps, so that they become regions of constant thickness, the thickness of the whole design becomes constant. Thus, each step gives rise to the same average thickness, or the average thickness of each step deviates by less than 25% from the average thickness of the whole lens, or even deviate by less than 10% from the average thickness.

Figure 11:
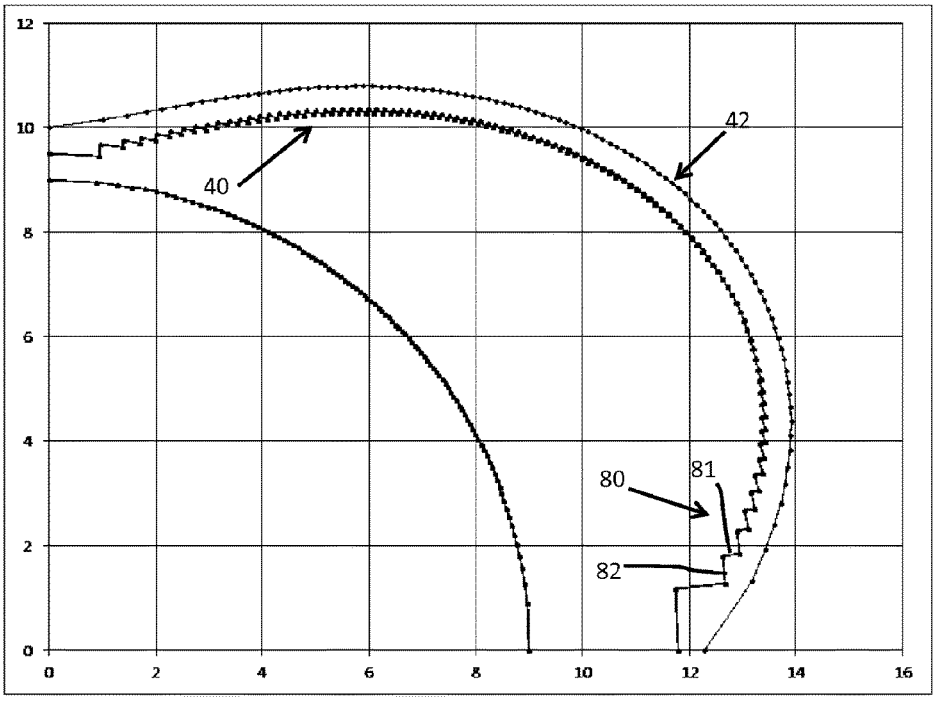
FIG. 11 shows the shapes of the stepped portion in more detail for a peanut lens.

The same approach as shown in FIGS. 9 and 10 may be applied to a peanut lens as shown in FIG. 11.

FIG. 11 shows one enlarged portion, which has a dome like outer surface. The lens is symmetrical about the vertical axis in FIG. 11 so that there is a similar enlarged portion at the other side, and the cross section shown is of a vertical plane which passes through the length axis of symmetry. Further details of this type of so-called peanut lens are for example provided in U.S. Pat. No. 8,293,548. The term "peanut lens" refers generally to a peanut shape, namely with two enlarged portions, one at each end of an elongate length direction.

Like FIG. 10, FIG. 11 shows the set of facets 80 and shows the riser portions 81 and the output portions 82. The riser portions 81 are parallel with the incident ray direction and the output portions are perpendicular to that ray direction. The facetted surface is the inner surface 40, and it is brought out towards the outer surface 42 to achieve the thickness uniformity in the same way as explained above.

The examples above show that the desired batwing output intensity distribution is maintained.

Note that the bubble lens designs above are all assumed to be rotationally symmetric about the normal (optical axis) direction. Thus, the lens has a circular base around the LED and the Fresnel plate is a rotationally symmetric plate. However, a circular design is not essential. For example, the same approach may be adopted for extrusion symmetric designs, i.e. line sources. The peanut lens design is also not fully rotationally symmetric.

The optical arrangement may be designed to create a highly collimated light source. However, this means that most of the light will pass unaltered through the filter grid, which may result in some cases that when viewing the luminaire under an angle, the light level of the blue light is too low, so that effect is of a dark sky.

There are a number of options for addressing this potential issue.

Figure 12:
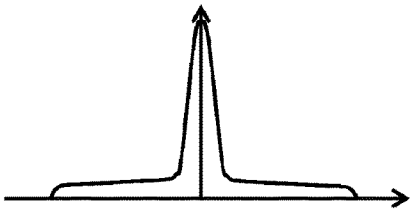
FIG. 12 shows a modified output from the collimator to ensure adequate steep angle light.

The collimator 50 may be designed in such a way that the beam is wider or has a large low level tail, as shown in FIG. 12.

An alternative is to add a second light source for the blue (sky) component. This can be an edge lit transparent light guide containing scattering particles. The light guide can be placed in front of the collimator 50 with and blue LEDs used as the light source. The collimated light will be almost unaffected when it passes through the light guide (because it only traverses the thickness of the light guide). The blue light from the blue edge LEDs is scattered uniformly throughout the light guide in all directions, resulting in a uniformly blue area light in all directions.

The blue part in the normal direction is essentially drowned out by the direct white illumination, but it becomes visible at larger angles. This has the additional advantage of allowing independent control of the sky and sun components. Other colors of LED may of course be used to create different colors of sky (e.g. sunset, sunrise . . . ).

The lens for example has dimensions which are chosen in dependence on the diameter D of the light source. By way of example:

the distance between the light source and the collecting surface at the optical axis is typically in the range 1 to 20 times D;

the lens height is typically in the range 1 to 20 times D plus the minimal lens thickness;

the lens width is typically in the range 0.5 to 3 times the lens height (1 to 20 times D), which yields 0.5-60 times D.

These dimensions take account of the fact that the LED is not an ideal point source. For example, the light output area of the LED may be 1 mm×1 mm (i.e. D=1 mm). By maintaining a distance to the collecting surface (the surface 40) of between 1 mm and 20 mm, the optical output function is maintained despite the non-point size of the LED. The larger end of the range will give rise to better optical performance, whereas the lower end of the range will give better opportunities for miniaturization and reduction of material.

By way of example, for the stepped design, the further the riser portions are away from the LED source, the closer the angular range of light will be to the desired parallel direction. Similarly, the further the light output portions are away from the LED source, the closer the angular range of light will be to the desired perpendicular direction.

This is just one example of LED size. For example, D may typically lie in the range 0.2 mm to 5 mm.

Figure 13:
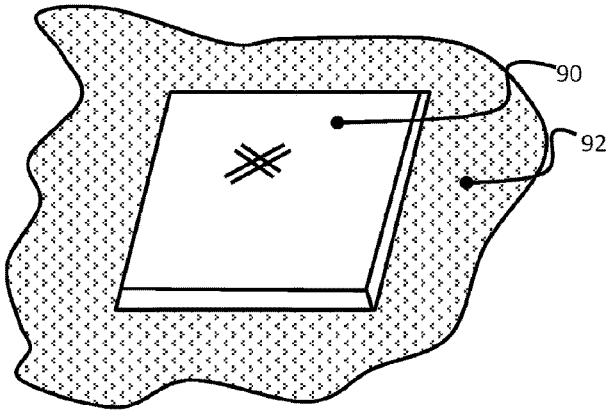
FIG. 13 shows a lighting system formed as an artificial daylight skylight.

The invention is of particular interest for an artificial skylight luminaire. FIG. 13 shows a lighting panel 90 in the form of a recessed skylight or a recessed artificial skylight. The lighting panel 90 is recessed into a ceiling 92 or it may be mounted flush with the ceiling, to give the impression of a window to daylight. The full module preferably has a thickness so that it can be mounted as part of the ceiling without requiring addition recessing. It may have a thickness of less than 10 cm. To create a panel area, an array of LEDs, each with the optical system described above, may be used.

Figure 14:
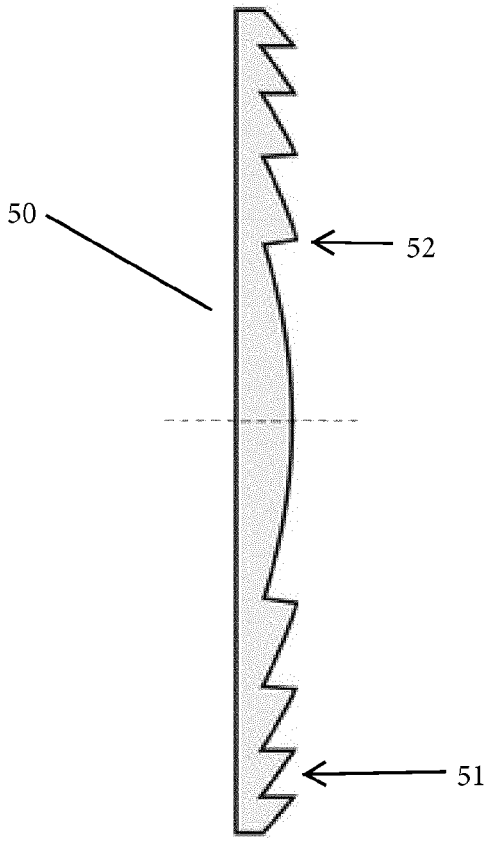
FIG. 14 shows a cross section of a Fresnel lens suitable for use in a lighting module.

FIG. 14 shows a cross section of the Fresnel lens 50, the prisms 51 in the outer region of the lens may be colored and the prisms 52 in the center of the lens may be non-colored. The light passing through the central region will remain the same color as emitted by the LED whilst the light passing through the outer region of colored prisms may become colored, preferably the light may become blue.

The luminaire may be oriented horizontally to emit light downwardly, but this is not essential. The luminaire may be for mounting in a different orientation.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lighting module comprising:

an LED (44);

a lens over the LED to produce a beam-shaped output from the LED;

a collimator arranged to partially collimate the beam-shaped output, said collimator comprising a total internal reflection Fresnel lens; and a blue light generator for providing blue light at relatively large angles to the normal, the relatively large angles being angles greater than 40 degrees away from the normal, wherein the collimator provides an output which comprises a narrow collimated relatively high intensity beam and a wide relatively low intensity beam; and wherein the blue light generator further comprises a filter arrangement over the collimator, the filter arrangement being adapted to filter light from the collimator at the relatively large angles to the normal to provide blue light; and wherein the filter arrangement does not filter light from the collimator at relatively small angles to the normal, the relatively small angles being less than 40 degrees away from the normal.

2. A lighting module as claimed in claim 1, wherein the filter arrangement comprises an array of blue filter cells which extend parallel to the normal direction.

3. A lighting module as claimed in claim 1, wherein the LED generates an output with a Lambertian intensity distribution.

4. A lighting module as claimed in claim 1, wherein the the lens comprises an inner surface and an outer surface, wherein one of the the inner and outer surfaces is a beam shaping surface which provides a beam shaping function, and the other of the inner and outer surfaces is a pass through surface which provides a pass through function.

5. A module as claimed in claim 4, wherein the beam shaping surface is shaped such that rays emitted along the optical axis are refracted away from the optical axis by at least 5 degrees, and rays approaching 90° to the optical axis are refracted towards the optical axis by at least 5 degrees.

6. A module as claimed in claim 4, wherein the inner surface is the beam shaping surface and the outer surface is the pass through surface, wherein the lens comprises a bubble lens.

7. A lighting module as claimed in claim 4, wherein the pass through surface has a stepped profile, wherein the steps of the stepped profile each comprise a riser portion and an output portion, wherein the riser portions are parallel with a ray direction originating from a point output of the LED and the output portions are normal to the ray direction.

8. A lighting module as claimed in claim 1, wherein output intensity of the lens has a batwing distribution.

9. A lighting module as claimed in claim 1, wherein the blue light generator comprises or further comprises a blue light source at the output of the collimator for providing a wide beam blue light output.

10. An artificial skylight comprising a lighting module as claimed in claim 1.

11. A method of generating a light output, comprising:

providing a light output from an LED (44);

beam shaping the light output using a lens to create a beam-shaped output;

partially collimating the beam-shaped output using a total internal reflection Fresnel lens;

providing blue light at relatively large angles to the normal, the relatively large angles being angles greater than 40 degrees away from the normal; and filtering the light output from the collimator at the relatively large angles to the normal to provide blue light; and passing the light output from the collimator at relatively small angles to the normal unfiltered through the filter, the relatively small angles being less than 40 degrees away from the normal.

* * * * *